US005190448A

United States Patent [19]

Lane et al.

[11] Patent Number: 5,190,448

[45] Date of Patent: Mar. 2, 1993

[54] TUBE PLACEMENT AND RETENTION MEMBER

[75] Inventors: John A. Lane, Watertown; Frederick C. Deno, Brownville; Frederick F. Schweitzer, Jr., Watertown, all of N.Y.

[73] Assignee: Sherwood Medical Company, St. Louis, Mo.

[21] Appl. No.: 730,184

[22] Filed: Jul. 12, 1991

[51] Int. Cl.[5] ..... F04B 43/08

[52] U.S. Cl. ..... 417/474

[58] Field of Search ..... 417/474–478

[56] References Cited

U.S. PATENT DOCUMENTS

| | | | |
|---|---|---|---|
| Re. 27,376 | 5/1972 | Pickup | 417/477 |
| 2,102,523 | 12/1937 | Ferrara et al. | 417/477 |
| 3,137,240 | 6/1964 | Hunt | 417/477 |
| 3,138,104 | 6/1964 | Cantor | 417/477 |
| 3,227,092 | 1/1966 | Clark, Jr. | 417/477 |
| 3,402,673 | 9/1968 | Ballentine et al. | 417/477 |
| 3,523,000 | 8/1970 | Miller | 417/477 |
| 3,567,345 | 3/1971 | Ballentine | 417/477 |
| 3,723,030 | 3/1973 | Gelfand | 417/475 |
| 3,739,717 | 6/1973 | Brown et al. | 417/475 |
| 3,885,894 | 5/1975 | Sikes | 417/477 |
| 3,963,023 | 6/1976 | Hankinson | 417/477 |
| 4,138,205 | 2/1979 | Wallach | 417/477 |
| 4,179,249 | 12/1979 | Guttmann | 417/477 |
| 4,181,476 | 1/1980 | Malbec | 417/477 |
| 4,256,442 | 3/1981 | Lamadrid | 417/475 |
| 4,412,793 | 11/1983 | Stenberg et al. | 417/477 |
| 4,472,116 | 9/1984 | Wenstrup | 417/477 |
| 4,500,269 | 2/1985 | Jess | 417/476 |
| 4,515,535 | 5/1985 | D'Silva | 417/477 |
| 4,527,323 | 7/1985 | Dawson | 417/477 |
| 4,552,516 | 11/1985 | Stanley | 417/477 |
| 4,735,558 | 4/1988 | Kienholz et al. | 417/477 |
| 4,798,590 | 1/1989 | O'Leary et al. | 604/153 |
| 4,856,972 | 8/1989 | Van Benschoten et al. | 604/153 |
| 4,913,703 | 4/1990 | Pasqualucci et al. | 604/153 |
| 4,925,376 | 5/1990 | Kahler | 417/477 |
| 5,064,358 | 11/1991 | Calari | 417/477 |

*Primary Examiner*—John J. Vrablik
*Assistant Examiner*—Peter Korytnyk
*Attorney, Agent, or Firm*—Andrew J. Beck; Montgomery W. Smith; Gene B. Kartchner

[57] ABSTRACT

A pump assembly used in conjunction with a fluid delivery set is disclosed which includes a tube slot into which the outlet tube of the fluid delivery set is intended to be mounted. The invention includes a retention member which is pivotally attached to the pump adjacent the point at which the outlet tube exits the tube slot of the pump assembly. The retention member includes a pivoting flat elongate arm which is secured to the pump by a pin and designed to rotate from a first position wherein the tube can be placed into the tube slot, and a second position wherein the tube is secured in the tube slot by the arm. The arm also has formed thereon a tab member which includes a tapered guide edge for ensuring that the tubing is forced into a secured position within the tube slot when the arm is pivoted thereover.

14 Claims, 3 Drawing Sheets

TUBE PLACEMENT AND RETENTION MEMBER

BACKGROUND OF THE INVENTION

1. Field of the Invention

This invention relates generally to fluid delivery systems. More particularly, the present invention relates to a tube retention member for ensuring proper placement and retention of a tube of a fluid delivery set within a pump assembly, the pump and fluid delivery set. A specific application of the invention is found in the medical field, such as on fluid delivery systems adapted for parenteral or enteral fluid infusion into a patient.

2. Description of the Prior Art

It is common for fluid delivery systems such as systems which deliver fluids to patients for medical purposes, to include a pump assembly and a fluid delivery set. The pump assembly usually includes a peristaltic pump, and the fluid delivery set usually includes a fluid reservoir with a delivery tube extending therefrom, the delivery tube often including a drip chamber mounted in flow communication therewith, and an outlet tube extending to the patient. Pump assemblies of this type are often designed with recesses and/or slots which allow mounting of the fluid delivery set thereto in a secure manner. For example, a recess may be designed to accept and retain the drip chamber, and slots may be formed to accept and retain the delivery and outlet tubes. The fluid delivery set is mounted on the pump assembly in such a manner that a portion of the outlet tube engages the peristaltic pump such that the pump can deliver fluid from the fluid reservoir to the patient in a controlled manner. A pump assembly and fluid delivery set constituting a fluid delivery system which is examplary of the prior art is disclosed in U.S. Pat. No. 4,913,703 to Pasqualucci et al.

It is extremely important that the fluid delivery set be properly mounted in the pump assembly in order to ensure that fluid is delivered to the patient thereby in the intended manner. It is also important that the fluid delivery set remain securely in place within the pump assembly during the entire infusion period to ensure the safety of the patient. Proper, secure mounting of the fluid delivery set to the pump assembly is not always accomplished however in practice. For example, should a medical worker fail to completely insert the fluid set within the pump assembly, such as by failing to completely insert the outlet tube within the tube slot, the pump may fail to deliver the fluid in the intended manner, which may have a deleterious or even fatal effect on the patient. As another example, a properly inserted fluid delivery set may become partially dislodged by movement of the pump assembly or patient during infusion, resulting in improper fluid delivery by the system. Should the pump assembly be jarred or dropped, pulling the pump assembly away from the fluid set, or inversely, should the patient move in such a way to cause the outlet tube of the fluid set to be pulled away from the pump assembly, partial disengagement of the fluid set from the pump assembly may result, which in turn may result in improper fluid delivery to the patient.

There therefore exists a need in the art to develop a fluid delivery system which includes a pump assembly which can retain a fluid delivery set, especially the outlet tube thereof, in its proper installed position during infusion, and which can resist and even prevent unintended dislodgement of the tube. There is further a need in the art to develop a system as described above which can ensure that proper placement of the fluid delivery set within the pump assembly occurs and that the tubing remains properly and completely locked in position during the infusion process.

OBJECTS AND SUMMARY OF THE INVENTION

It is an object of the present invention to provide a pump assembly of a fluid delivery system with a tube retention member capable of assisting in placement and retention of a tube therein during infusion.

It is another object of the present invention to provide a retention member as described above which is movable to an open position to allow insertion and removal of tubing of the fluid delivery set from the pump assembly, and a closed position which inhibits removal of the tube.

It is another object of the present invention to provide a retention member as described above which also assists in properly placing the tube within the pump assembly.

These and other objects of the present invention are realized in an embodiment of a tube retention device which includes an elongate flat arm member pivotally mounted to a pump assembly at a position adjacent a tube slot of the assembly such that the retention device can pivot between a first position in which placement and removal of a tube into and out of the tube slot is unobstructed thereby, and a second position wherein the retention member covers at least a portion of the tube slot and prevent insertion or removal of a tube. The elongate flat arm member may be secured to the pump assembly by a pivot pin located at one end thereof, and the arm may include a tab located generally at the opposite end thereof from the pin, and which extends generally at an angle away therefrom such that the tab will be located at least partially within the tube slot when the retainer is in the closed position. The tab can also include a tapered guide edge which contacts the outlet tube if it is located in an unsecured position within the tube slot, and forces the tube to a secured position therein as the arm moves from its open to its closed position. The retainer may also include a grip member located on the arm thereof which is sized to allow easy actuation of the arm between its open and closed positions by a finger or thumb of a medical worker.

These and other objects and advantages of the invention will be fully realized in the accompanying specification including the drawings thereof, in which similar elements are identified with like numerals throughout each of the figures.

BRIEF DESCRIPTION OF THE DRAWINGS

FIG. 2(*b*) is a rear view of a retention device formed in accordance with the principles of the present invention;

FIG. 4(*b*) is a front view of a portion of the pump assembly showing the retention device of the present invention positioned as in FIG. 4(*a*);

FIG. 5(*b*) is a front view of a portion of the pump assembly showing the retention device of the present invention positioned as in FIG. 5(*a*);

FIG. 6(*b*) is a front view of a portion of a pump assembly showing the retention device of the present invention rotated to the closed position as shown in FIG. 6(*a*).

DETAILED DESCRIPTION OF THE INVENTION

Figure 1:
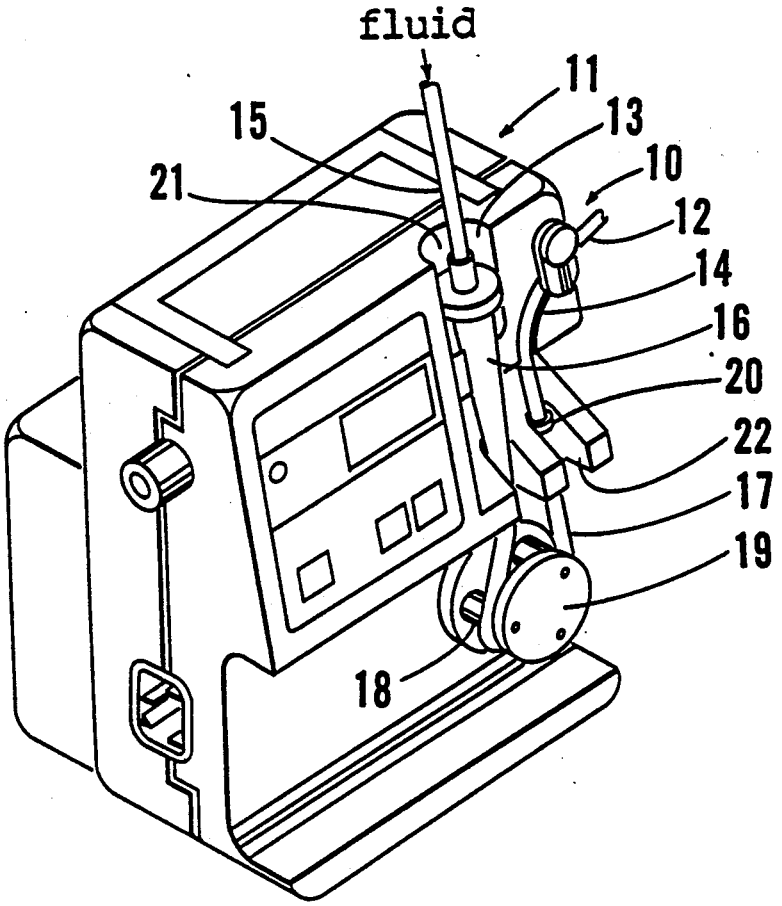
FIG. 1 shows a fluid delivery system including a fluid delivery set properly installed on a pump assembly, with a retention device made in accordance with the principles of the present invention located on the pump assembly and rotated into its closed position over the outlet tube of the delivery set.

As shown in the exemplanary drawings for the purposes of illustration, an embodiment of a retention device made in accordance with the principles of the present invention, referred to generally by the reference numeral 10, is provided on a pump assembly 11 for assisting in placing and locking an outlet tube 12 of a fluid delivery set 13 within a tube slot 14 of the pump assembly 11.

More specifically, as shown in FIG. 1, an entire fluid delivery system is shown which includes the pump assembly 11 with the fluid delivery set 13 attached thereto in its operational configuration. The fluid delivery set 13 includes a fluid storage container, such as a bag or bottle (not shown), a delivery tube 15 extending from the fluid storage container to a drip chamber 16, a mounting member 20, and an outlet tube 12, a portion 17 of which extends from the drip chamber 16 and around the rollers 18 of the rotor 19. The drip chamber 16 and the mounting member 20 are arranged to be received in recesses 21 and 22 respectively of the pump assembly 11. The outlet tube 12 is arranged to be received within the tube slot 14 of the pump assembly 11 and to extend to the patient (not shown).

Figure 2A:
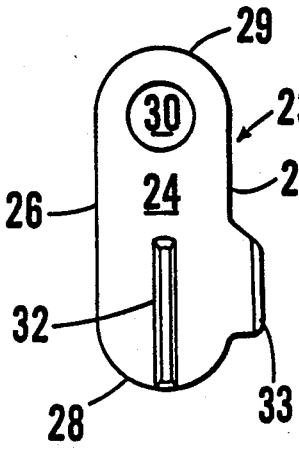
FIG. 2(*a*) is a front view of a retention device formed in accordance with the principles of the present invention.
Figure 2B:
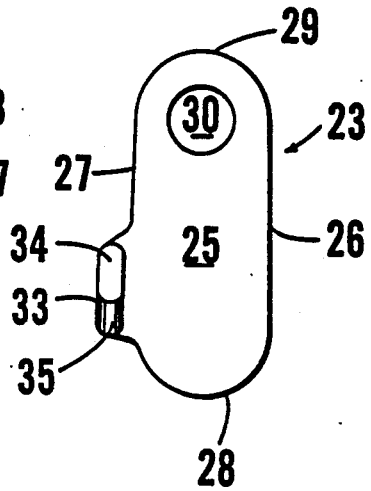

As shown in FIGS. 2(*a*) and (*b*), the retention device 10 of the present invention is preferably formed of a flat elongate arm 23, having generally flat top and bottom surfaces 24 and 25 respectively, and generally parallel side surfaces 26 and 27, and ends 28 and 29 which are generally semi-circular in shape.

A pivot pin opening 30 is formed adjacent end 29 of the arm 23 through which the pivot pin 31 (best shown in FIG. 3) is inserted for mounting onto the pump assembly 11. A grip member 32 shaped as a generally elongate ridge is integrally formed on the front surface 24 of the arm 23 and oriented generally longitudinally there along to extend parallel with sides 26 and 27. It should be understood that although grip member 32 is shown and described as an elongate ridge, any structure located on, or formed from, front surface 24 which is adapted or can be adapted to increase the gripability of the arm 23 for rotational purposes could be used on the present invention in conjunction with or in place of the grip member 32 without departing from the scope or intent of the present disclosure.

The side surface 27 of arm 23 has integrally formed thereon a tab member 33 which extends generally perpendicularly away from the back surface 25 of the arm 23. The tab member 33 forms an end surface 34 and a tapered guide edge 35. The tab 33 is strategically located on the arm 23 such that rotation of arm 23 about the pivot pin 31 will allow the tapered guide edge 35 and the tab end 34 to function to properly position, and subsequently secure, the outlet tube 12 within the tube slot 14 in a manner which will be explained in detail below.

Figure 3:
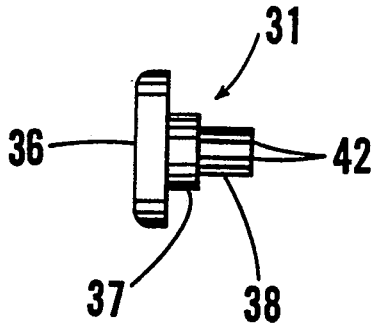
FIG. 3 is a side view of a pivot pin for holding the retention device on the pump assembly.

As shown in FIG. 3, the pivot pin 31 is formed with a head 36 having a larger diameter than the pivot pin opening 30, and a bearing surface 37 having a diameter which will allow it to be snugly fit within the pivot pin opening 30 of the arm 23, yet allow relative rotation therewith in response to manual pressure against grip 32.

Figure 4A:
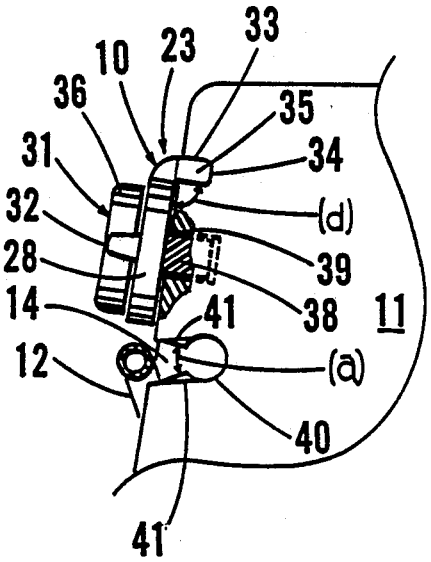
FIG. 4(*a*) is a side view of a portion of the pump assembly showing the retention device of the present invention rotated to its open position and the outlet tube of a fluid set inserted to a non-secure position within the tube slot of the pump assembly.
Figure 4B:
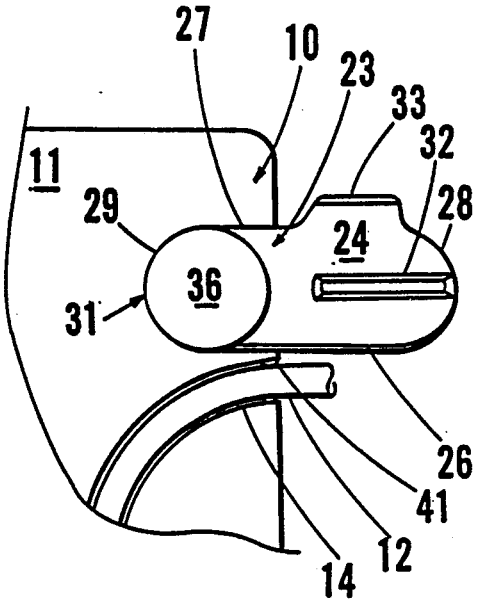

The pin 31 includes an extension 38 which is of a smaller diameter than the bearing surface 37. As best seen in FIG. 4(*a*), the pivot pin 31 is inserted through pivot pin opening 30 of the arm 23 until head 36 contacts front surface 24, and bearing surface 37 is located within the pivot pin opening 30. The extension 38 is then inserted into the pin mounting hole 39 of the pump assembly 11 which is sized to create a very snug fit therewith.

If desired, the extension 38 may also include grooves 42 thereon to assist in the flow of adhesive material between the extension 38 and the pin mounting hole 39. Also, although not shown, any other securing means such as friction fitting, chemical bonding or the like may be used to ensure that loosening of the pin 31 or rotation thereof relative to pump assembly 11 is prevented.

OPERATION OF THE INVENTION

Referring now to FIGS. 4(*a*) and (*b*), the retention device 10 of the present invention is shown in its "open" position wherein the arm 23 is rotated completely away from the tube slot 14. While in this position, the outlet tube 12 can be inserted into the tube slot 14 without interference or obstruction by the retention device 10. The outlet tube 12 is shown to be inserted into tube slot 14 except at the outlet 40 thereof. As can be most easily seen in FIG. 4(*a*), the outlet 40 includes a pair of ramps 41 which effectively reduce the width of the outlet 40 relative to the width of the remainder of the tube slot 14. The reduced width (a) between the ramps 41 is designed to be slightly smaller than the diameter of the outlet tube 12, causing it to be pinched as it passes into the tube slot 14 (see FIG. 5(*a*)). Once the outlet tube 12 moves past the ramps 41, it can return to its normal diameter (see FIG. 6(*a*)) and is thereafter inhibited from escaping the tube slot 14 by the ramps 41.

Due to the often extremely dangerous effects of miss operation (or failure of operation) of a fluid infusion system on a patient, it is extremely important to ensure that the outlet tube 12 is properly placed within the tube slot 14 before beginning infusion. It is further very important to ensure that the outlet tube 12, once properly placed within tube slot 14, will remain properly placed irregardless of random movements of the outlet tube 12 or pump assembly 11.

Figure 5A:
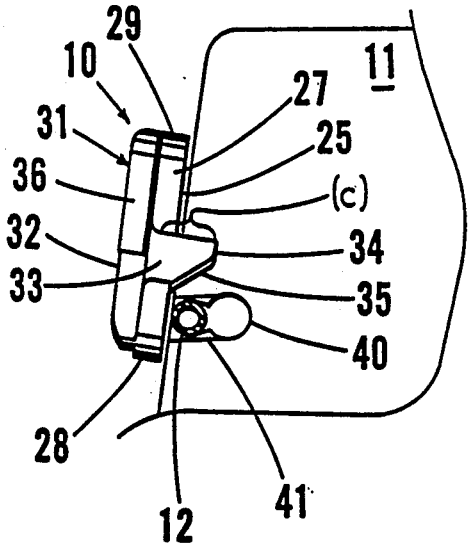
FIG. 5(*a*) is a side view of a portion of the pump assembly including the retention device of the present invention rotated approximately half way between its open and closed positions, showing the outlet tube of the fluid set held in the position shown in FIGS. 4(*a*) and 4(*b*), by the arm of the retention device.
Figure 5B:
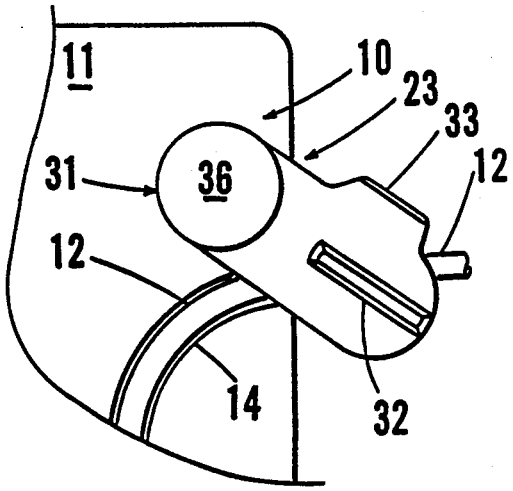

The retention device 10 of the present invention operates both to ensure proper placement of the outlet tube 12 into the tube slot 14 and also to maintain (in a locking fashion) the tube 12 in its proper placement in tube slot 14 throughout an entire infusion procedure. An example of the necessity and usefullness of the present invention occurs when a medical worker inadvertently fails to completely insert the tube 12 past the ramps 41 at the outlet 40 of the tube slot 14. As shown in FIG. 5(*a*), an outlet tube 12 inserted under these circumstances may become wedged between the ramps 41 and may appear to the medical worker to be completely and properly inserted. Without the aid of the retention device 10, the tube 12 could easily slip outwardly over the ramps 41 and fall out of the tube slot 14, with possibly dangerous results. However, if the pump assembly 11 is fitted with the retention device 10 of the present invention, the medical worker can merely apply a rotational force to grip 32 (such as with a finger or thumb) and rotate grip 32 until the back surface 25 of the arm 23 covers the outlet 40 of slot 14. Once the arm 23 is rotated to this position (see FIGS. 5(*a*) and (*b*)), the tube 12 can no longer be removed from the slot 14. However, even with tube 12 effectively held within the tube slot 14 by the back surface 25 of arm 23, it nevertheless remains pinched between the ramps 41. While in this position, the tube 12 is partially restricted in such a manner that fluid flow therethrough may be affected.

Figure 6A:
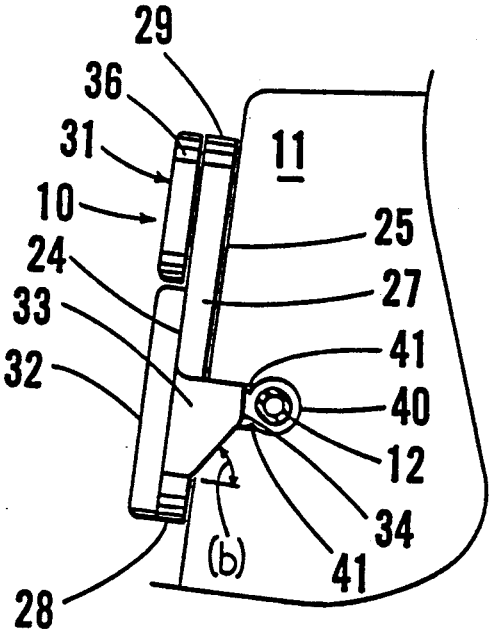
FIG. 6(*a*) is a side view of a portion of the pump assembly including the retention device of the present invention rotated to its closed position and the outlet tube of the fluid set inserted to a secure position within the tube slot of the pump assembly.
Figure 6B:
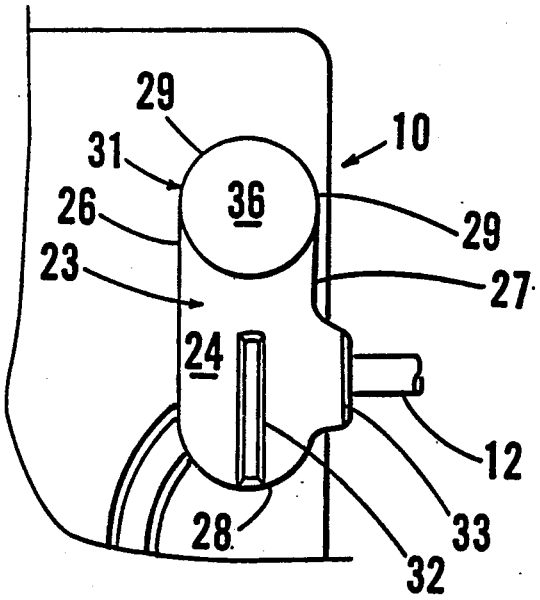

Continued rotation of the arm 23 from its position as shown in FIGS. 5(*a*) and (*b*) to its position in FIG. 6(*a*) and (*b*), causes the tapered guiding edge 35 of the tab member 33 to contact and move the tube 12. The angle (b) of the tapered guide edge 35 is predetermined to cause the rotation of the arm 23 to force the tube 12 to slide along the tapered guide edge 35 in an inward direction toward the bottom of tube slot 14. The length (c) of extension of the tab member 33 beyond the back surface 25 of the arm 23 is predetermined to be of a sufficient length that once tube 12 has slid entirely along the tapered guide edge 35, it will have progressed inwardly into tube slot 14 a sufficient distance to clear ramps 41 to a secured position, and return to its normal shape.

As best seen in FIG. 6(*a*) and (*b*), the retention device 10 has been completed rotated into its "closed" position, and the tube 12 has been forced beyond the ramps 41 and is completely and properly inserted within the tube slot 14. Further, the tab end 34 of the tab member 33 is located directly adjacent to outlet 40 of the tube slot 14 and effectively blocks the tube 12 against exiting the slot 14. As is readily evident, any pressure of tube 12 against tab end 34 will generate a force on the retention device 10 which is substantially parallel to the axis of rotation thereof about pin 31. Any force which would tend to move tube 12 out of tube slot 14 would therefore not be capable of causing of rotation of the arm 23. Thus, the tube 12 is effectively locked in its proper position within tube slot 14 until the user again initiates rotation of the arm 23 to move it back to its "open" position as shown in FIGS. 4(*a*) and (*b*).

It will be apparent from the foregoing that, while a particular embodiment of the invention has been illustrated and described, various modifications and adaptations may be made thereto without departing from the spirit and scope of the invention. For example, the tab member 33 need not extend precisely at a perpendicular angle away from back surface 25 of arm 23, any suitable angle (d) as shown in FIG. 4(*a*) which will accommodate the particular pump assembly 11 is contemplated by the present invention. Similarly, the length (c) of the tab member 33 (as shown in FIG. 5(*a*)) may also be adjusted to accommodate the particular design of the pump assembly 11. As well, the particular angle (b) of the tapered guide edge 35 (as shown in FIG. 6(*a*)) may be adjusted to suit the particular size of tube 12 used, and the particular shape and design of the tube slot 14.

Also, other embodiments of the invention having substantially different shape characteristics, nevertheless retaining substantially similar placement and retention functions, are anticipated and considered to be within the scope of the present invention. Accordingly, it is not intended that the invention be limited in any way, except as by the appended claims.

What is claimed is:

1. A retention means for assisting in placing and locking a medical tube within a retention slot formed in an assembly, said retention means comprising:

means for retaining the tube in the slot, said means for retaining including an elongate arm being movable relative to the retention slot from a first position wherein the tube is positionable with the retention slot, to a second position wherein at least a portion of said means for retaining the tube covers at least a portion of the slot;

means for moving the tube within the slot in response to movement of said means for retaining the tube between said first position and said second position; and means for mounting said retention means adjacent the retention slot said means for moving the tube including a tab member extending from said elongate arm for contacting the tube within the slot.

2. A retention means according to claim 1 wherein said means for retaining the tube includes an elongate arm.

3. A retention means according to claim 2 wherein said means for mounting said retention means includes a pivot pin, and said elongate arm is pinned for pivotal rotation adjacent the retention slot by said pivot pin, whereby, when said means for retaining the tube is located in said second position, at least a portion of said elongate arm covers at least a portion of the slot.

4. A retention means according to claim 2 wherein said means for moving the tube further includes a tab member extending from said elongate arm and said tab member includes a guide edge thereon, whereby, movement of said means for retaining the tube between said first position and said second position causes said guide edge to contact and move the tube within the slot.

5. A retention means according to claim 4 wherein said tab member further includes an end surface located adjacent said guide edge, whereby said end surface is positioned adjacent the tube when said means for retaining the tube is located in said second position.

6. A retention means according to claim 1 wherein said means for retaining the tube further includes gripping means, whereby, said means for retaining the tube can be moved between said first position and said second position by a force applied to said gripping means.

7. A retention means according to claim 1 wherein said means for moving the tube within the slot includes a guide edge, whereby, movement of said means for retaining the tube between said first position and said second position causes said guide edge to contact the tube to move the tube within the slot.

8. A pump assembly including a retention means for assisting in placing and locking a medical fluid infusion tube within a retention slot of a pump assembly, said retention means comprising:

elongate arm means for retaining the infusion tube in the retention slot, said elongate arm means being pivotable on the pump assembly from a first position wherein the tube is positionable within the retention slot, to a second position wherein at least a portion of said elongate arm means covers at least a portion of the slot;

tab means located on said elongate arm means for moving the tube within the slot from an unsecured position to a secured position in response to movement of said elongate arm means from said first position to said second position; and pin means for pivotally mounting said elongate arm means to the pump assembly.

9. A method of securing a medical tube within a retention slot of an assembly, said method including the steps of:

rotating a retention means including an elongate arm into a first position;

positioning the tube within the slot;

rotating the retention means from the first position to a second position such that a tab member extending from the elongate arm functions as a moving means to move the tube from an unsecured position within the slot to a secured position within the slot at the second position wherein at least a portion of the retention means covers at least a portion of the slot.

10. A method according to claim 9 wherein the moving means further includes means for inhibiting subsequent removal of the tube from the slot, and said step of moving the tube within the slot further includes:

inhibiting movement of the tube from the secured position while the retention means is located in the second position.

11. A method for securing a medical fluid infusion tube within a retention slot of a pump assembly, said method including the steps of:

rotating an elongate arm means into a first position;

inserting the tube into the slot;

rotating the elongate arm means from the first position to a second position wherein at least a portion of the elongate arm means covers at least a portion of the slot; and using a tab means associated with the elongate means to move the tube form an unsecured position within the slot to a secured position within the slot as the elongate means is rotated between the first and second positions.

12. A method according to claim 11 wherein the tab means further includes end surface means, and said step of moving the tube within the slot further includes:

inhibiting movement of the tube from the secured position with the end surface means while the elongate arm means is located in the second position.

13. A method according to claim 12 further including guide edge means associated with the tab means, said method further including the steps of:

contacting and moving the tube from the unsecured position to the secured position with the guide edge means when the elongate arm means is moved between the first and second positions.

14. A retention means for assisting in placing an locking a medical tube within a retention slot formed in an assembly, said retention means comprising:

means for retaining the tube in the slot, said means for retaining including an elongate arm which is movable relative to the retention slot from a first position wherein the tube is positionable within the retention slot, to a second position wherein at least a portion of said means for retaining the tube covers at least a portion of the slot;

means for moving the tube within the slot in response to movement of said means for retaining the tube between said first position and said second position, said means for moving the tube including a tab member extending from said elongate arm and said tab member including a guide edge and an end surface located adjacent said guide edge; and means for mounting said retention means adjacent the retention slot;

whereby, movement of said means for retaining the tube between said first position and said position causes said guide edge to contact and move the tube within the slot, and causes said end surface to be positioned adjacent the tube when said means for retaining the tube is located in said second position.

* * * * *